US006190819B1

(12) United States Patent
Takahashi et al.

(10) Patent No.: US 6,190,819 B1
(45) **Date of Patent: *Feb. 20, 2001**

(54) ELECTROSTATIC IMAGE-DEVELOPING TONER

(75) Inventors: Noriaki Takahashi; Osamu Ando, both of Yokohama (JP)

(73) Assignee: Mitsubishi Chemical Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/075,928

(22) Filed: May 12, 1998

(30) Foreign Application Priority Data

May 12, 1997 (JP) ..... 9-120754

(51) Int. Cl.[7] ..... G03G 9/097; G03G 9/087
(52) U.S. Cl. ..... 430/137; 430/109; 430/110
(58) Field of Search ..... 430/137, 110, 430/109, 111

(56) References Cited

U.S. PATENT DOCUMENTS

| | | | | |
|---|---|---|---|---|
| 4,099,968 | | 7/1978 | Scouten et al. . | |
| 4,168,254 | * | 9/1979 | Fell | 260/29.2 |
| 4,839,255 | * | 6/1989 | Hyosu et al. | 430/137 |
| 4,923,776 | * | 5/1990 | Hedvall et al. | 430/111 |
| 5,215,854 | * | 6/1993 | Yamazaki et al. | 430/137 |
| 5,385,799 | * | 1/1995 | Ono et al. | 430/110 |
| 5,547,796 | * | 8/1996 | Kohtaki et al. | 430/110 |
| 5,629,124 | * | 5/1997 | Ono et al. | 430/110 |

FOREIGN PATENT DOCUMENTS

| | | |
|---|---|---|
| 0 324 529 | 7/1989 | (EP) . |
| 0 725 320 | 8/1996 | (EP) . |

OTHER PUBLICATIONS

Patent Abstracts of Japan, vol. 14, No. 226 (P–1047), May 14, 1990, JP 02 053077, Feb. 22, 1990.
ACS File Registry RN 12237–22–8 (Copyright 2000 ACS).*
Neufeldt, V. et al. ed. Webster's New World Dictionary, Third College Edition, Webster's New World, NY (1988), p. 903.*

* cited by examiner

*Primary Examiner*—Janis L. Dote
(74) *Attorney, Agent, or Firm*—Oblon, Spivak, McClelland, Maier & Neustadt, P.C.

(57) ABSTRACT

The present invention is directed to an electrostatic image-developing toner which is used for an electronograph and the like. The toner comprises at least core particles and fine particles being present on the surfaces of the core particles and has a mean particle size of 0.01–1 $\mu$m. The fine particles are polymer of a monomer and contain charge-controlling agent which is soluble in the monomer before polymerization.

8 Claims, No Drawings

ELECTROSTATIC IMAGE-DEVELOPING TONER

BACKGROUND OF THE INVENTION

The present invention relates to an electrostatic image-developing toner which is used for an electronograph and the like.

A developer to be used for an electronograph and the like is once adhered onto an image carrier, for example, such as a photosensitive material on which electrostatic images are formed, then transferred from the photosensitive material onto a paper in the transfer step, and then fixed onto a copy paper in the fixing step. In this case, as developers for developing electrostatic images formed on the latent image carrying surface, there have been known a dual-component developer comprising a carrier and a toner and a monocomponent developer requiring no carrier.

By the way, charging property is one of important properties required for the toner, and the formation of positive or negative charge having a proper level and the general stability of the charge level in the lapse of time are required even under its continuous use or under an adverse condition.

Previously, toners have been made in general by melting a binder resin and additives such as a charge-controlling agent with heat, admixing, pulverizing after cooling, and classifying. They have been also made by mixing a monomer and additives such as a charge-controlling agent and polymerizing the same.

However, toners produced by such methods show bad dispersibility of a charge-controlling agent, less charge stability and unstable print density when printed under an adverse condition during their continuous use. Also, to be present the charge-controlling agent on the surface of toner, which governs the charging property, it has been necessary to add a large amount of charge-controlling agent.

SUMMARY OF THE INVENTION

In view of the above, an object of the present invention is to provide a toner having high quality, which is excellent in charge stability even in a small amount of charge-controlling agent added, and provides a proper and stable print density when printed even under a continuous use or under an adverse condition.

Accordingly, the present inventors have made an intensive study, and found as a result of which that these problems may be solved by containing a charge-controlling agent only on the surface of the toner. Thus, the present invention has been accomplished.

Namely, the present invention provides an electrostatic image-developing toner comprising at least core particles and fine particles being present on the surface of the core particles and having a mean particle size of 0.01–1 $\mu$m, the fine particles being a polymer of monomer and containing a charge-controlling agent which is soluble in the monomer before the polymerization.

The present invention also provides an electrostatic image-developing toner in which the charge-controlling agent is a compound represented by general formula (1) or a quaternary ammonium compound:

$$A—(X—B)_n \quad (1)$$

wherein A represents an aromatic ring residue which may have a substituent, B represents an aromatic ring residue or an aliphatic residue which may have a substituent, or a hydrogen atom, X represents —CONH—, —NHCO— or —NHCONH—, and n is a natural number of one or more.

PREFERRED EMBODIMENTS OF THE INVENTION

The present invention will be illustrated in detail hereinafter.

As monomers of vinyl series to be used in the present invention, there are exemplified monomers of vinylaromatic series, monomers of (meth)acrylic ester series, (meth)acrylic acid monomers, monomers of vinylether series, and the like. Specific examples include, for example, monomers of vinyl aromatic series, such as styrene, α-methyl styrene, vinyl toluene, α-chlorostyrene, o-, m- and p-chlorostyrene, p-ethyl styrene, divinyl benzene; monomers of (meth)acrylic ester series, such as methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, 2-hydroxyethyl acrylate, 3-hydroxypropyl acrylate, 4-hydroxybutyl acrylate, 2-hydroxyethyl methacrylate, ethyleneglycol dimethacrylate, tetraethyleneglycol dimethacrylate; (meth)acrylic acid monomers such as acrylic acid, and methacrylic acid; monomers of vinyl ether series, such as vinyl-n-butyl ether, vinylphenyl ether, and vinylcyclohexyl ether.

These monomers may be used alone or two or more of them may be copolymerized.

Preferably, among these monomers, those of vinyl aromatic series or (meth)acrylic ester series may be used.

As charge-controlling agent to be dissolved in these monomers of vinyl series, there are exemplified those which may dissolve in an amount of more than 0.5 wt % at a temperature of polymerization in the vinyl monomer and in particular, preferably those which may dissolve in amount of more than 0.5 wt % at 20° C. More preferably, there are exemplified those which may dissolve in an amount of more than 2 wt % at 20° C.

The charge-controlling agent added to a vinyl monomer is preferably dissolved wholly at the polymerization to obtain uniform fine particles.

So long as the above-mentioned conditions are satisfied, the chemical structure of charge-controlling agent is not particularly limited but compounds represented by general formula (1) or quaternary ammonium compounds are particularly preferred.

In general formula (1), A represents an aromatic ring residue, which may have a substituent on the ring and may be a heterocyclic ring. Examples of A include aromatic ring residues having 4–30 carbon atoms and preferably, for example, a benzene ring residue, a naphthalene ring residue, an anthracene ring residue, a carbazole ring residue and the like. Particularly, a benzene and naphthalene ring residue are preferred.

B represents an aromatic ring residue which may have a substituent, an aliphatic residue which may have a substituent, or a hydrogen atom. The aromatic ring residue is the same as in A.

Further, as aliphatic residues, there are exemplified an alkyl radical (preferably $C_1$–$C_{25}$), an alkenyl radical (preferably $C_2$–$C_{22}$),an alkynyl radical (preferably $C_2$–$C_{22}$), an aliphatic ring residue which may have an atom other than carbon atom(preferably 3–7 members)and the like; For example, methyl, ethyl, n-propyl, i-propyl, n-butyl, i-butyl, tert-butyl, n-pentyl, i-pentyl, hexyl, heptyl, octyl, nonyl, decyl, undecyl, heptadecyl, behenyl, vinyl, allyl, propalgyl, cyclopentyl, cyclohexyl, pyrrolidine ring residue, piperidine ring residue, dioxane ring residue, morpholine ring residue and the like. The above-described aromatic ring and aliphatic residue in A and B may further have a substituent such as, for example, methyl, ethyl, n-propyl, i-propyl, n-butyl, i-butyl, tert-butyl; cyclohexyl; haloalkyl (fluoromethyl, difluoromethyl, trifluoromethyl, chloromethyl, bromomethyl, fluoroethyl, fluoropropyl, fluorobutyl, and the like); an alkyl (preferably 1–6 carbon atoms) which may be substituted, such as hydroxyalkyl (hydroxymethyl, dihydroxymethyl, trihydroxymethyl, hydroxyethyl, hydroxypropyl, hydroxybutyl and the like) with the proviso that the substitution to the alkyl is excluded; an alkenyl; amino, which may be substituted, such as amino, alkylamino, and dialkylamino (preferably 0–10 carbon atoms); alkoxyl (preferably 1–12 carbon atoms) such as methoxyl, ethoxyl, n-propoxyl, i-propoxyl, n-butoxyl, i-butoxyl, and tert-butoxyl; hydroxyl; a halogen atom such as hydroxyl, fluorine atom, chlorine, and bromine atom; nitro, cyano, acetyl, carboxyl, carboxymethyl, carboxyphenyl, phenyl, $C_1$–$C_6$ alkyl substituted phenyl, and the like.

X represents —CONH—, —NHCONH— or —NHCONH— and n is a natural number of one or more, preferably 1–3.

It is well known to use as a charge-controlling agent a certain kind of compounds of quaternary ammonium series (U.S. Pat. No. 3,893,935). The compounds of quaternary ammonium series include those containing a cationic component in which nitrogen atom is substituted with an alkyl or aralkyl radical. Specific examples of substituents include preferably methyl, ethyl, ptopyl, butyl, pentyl, hexyl, heptyl, octyl, decyl, lauryl, cetyl, mystyl, stearyl, benzyl or the benzyl, which is mono- or disubstituted by lower alkyl such as methyl and butyl or halogen such as chlorine. The anionic component may include an inorganic or organic mono- to trivalent compound, however it is preferable as a specific example substituted or unsubstituted organic sulfonic acid.

The structural formulae of preferred examples of the above-mentioned charge-controlling agents are described in Table 1 and 2, however, which are not limited thereto.

TABLE 1

| Compound No. | A | n | X | position of X | B |
|---|---|---|---|---|---|
| 1 | 3,5-bistrifluoro methylbenzene | 1 | —NHCO— | 1- | t-butyl |
| 2 | benzene | 2 | —CONH— | 1-,3- | 3,5-bis trifluoro methyl-benzene |
| 3 | 3,5-bistrifluoro methylbenzene | 1 | —NHCONH— | 1- | cyclohexyl |
| 4 | 3,5-bistrifluoro methylbenzene | 1 | —CONH— | 1- | H |
| 5 | benzene | 3 | —CONH— | 1-,3-,5- | 3,5-bistri-fluoro methyl-benzene |
| 6 | 4-methylbenzene | 1 | —CONH— | 1- | H |
| 7 | 4-t-butylbenzene | 1 | —CONH— | 1- | H |
| 8 | benzene | 2 | —CONH— | 1-,3- | 3-trifluoro methyl-benzene |
| 9 | benzene | 2 | —CONH— | 1-,3- | benzene |

TABLE 1-continued

| Compound No. | A | n | X | position of X | B |
|---|---|---|---|---|---|
| 10 | 3-trifluoro methylbenzene | 1 | —NHCO— | 1- | isopropyl |
| 11 | 4-trifluoro methylbenzene | 1 | —CONH— | 1- | H |
| 12 | benzene | 2 | —NHCONH— | 1-,3- | 4-trifluoro methyl-benzene |
| 13 | 5-t-butylbenzene | 2 | —NHCONH— | 1-,3- | 3,5-bis trifluoro methyl-benzene |
| 14 | benzene | 2 | —CONH— | 1-,4- | benzene |
| 15 | benzene | 2 | —CONH— | 1-,2- | benzene |
| 16 | benzene | 2 | —CONH— | 1-,4- | 4-chloro benzene |
| 17 | 5-t-butylbenzene | 2 | —CONH— | 1-,3- | benzene |
| 18 | 5-t-butylbenzene | 2 | —CONH— | 1-,3- | 3,5-bis trifluoro methyl-benzene |
| 19 | 5-t-butylbenzene | 2 | —CONH— | 1-,3- | 3-trifluoro methyl-benzene |

TABLE 2

| Compound No. | Cationic component | Anionic component |
|---|---|---|
| 20 | tributylbenzyl ammonium | 1-hydroxynaphtalene-4-sulfonic acid |
| 21 | tributyl p-methylbenzyl ammonium | 1,5-naphthalene disulfonic acid |
| 22 | dimethyldibenzyl ammonium | 1,5-naphthalene disulfonic acid |
| 23 | dimethylstearylbenzyl ammonium | 1-hydroxynaphthalene-4-sulfonic acid |

The amount of charge-controlling agent added to a is preferably 0.5–20 parts by weight referred to 100 parts of monomer, more preferably 1–10 parts by weight. A too small amount of charge-controlling agent contained does not provide a desired improvement in charging property and an excess amount of the agent causes the separation of monomer to the outside of the system in the way of polymerization of the monomer to deteriorate the quality of toner undesirably.

The polymerization is carried out preferably in the emulsion polymerization or in the soup-free emulsion polymerization. A common emulsifier may be used as an emulsifier to be used in the emulsion polymerization. As the initiator to be used in the emulsion or soup-free emulsion polymerization, a common water soluble initiator such as, for example, persulfate, hydrogen peroxide, and hydroperoxide may be used. A redox initiator comprising a combination of peroxide and reducing compound may be used. Further, a promoter represented by cupric sulfate may be used together with them.

The mean particle size of fine polymer particles containing a charge-controlling agent is 0.01 $\mu$m–1 $\mu$m, preferably 0.05 $\mu$m–0.5 $\mu$m. A too small mean particle size does not improve the charging property unexpectedly and a too large mean particle size deteriorates the quality of toner undesirably.

The core particle to be used in the present invention may be produced in a previously known method. For example, there is exemplified a method in which a resin and additives such as a colorants etc. are melt-mixed, pulverized and classified or a polymerization method in which a monomer and additives such as colorant etc. are polymerized in the suspension or emulsion polymerization. From the view point of the uniformity of additive and the like, a core toner is preferable which is obtained by the polymerization method.

Resins to be used in a method, in which a monomer and additives are melt-mixed, are known. For example, there are exemplified resins of styrene series, copolymer resins of styrene acrylic series, resins of polyester series, resins of epoxy series and the like.

While the monomer to be used in the polymerization method may be the same as the monomer to be used for the formation of fine particles, it may be preferred a monomer of vinyl aromatic series, (meth)acrylic ester series, (meth) acrylic acid and a mixture of two or more of them. The styrene monomer is preferable as a monomer of vinyl aromatic series. As a suspension stabilizer to be used in the suspension polimerization, a common suspension stabilizer, for example, tricalcium phosphate, silica, polyvinyl alcohol and the like, may be used. As an initiator, a common oil soluble initiator, for example, azobis-butylonitrile, azobis-dimethylvarelonitrile and the like, may be used.

The same monomer as one which is described in the formation of fine particles may be used for the emulsion polymerization.

The coagulated particles of the particles obtained in the emulsion polymerization may be used preferably as the core particles.

The colorant for the core particles is not critical and may be a common one. To obtain a black toner, carbon black and the like may be used. To obtain a colored toner of blue, red, yellow and the like, a colorant such as dye or pigment having a corresponding color may be used. The amount of colorant contained is preferably 3–20 parts by weight to 100 parts by weight of resin. Further, the core particles may contain an olefin polymer of low molecular weight for improving the fixing property, a known common charge-controlling agent, a dispersing agent for colorant, and the like.

The mean particle size of core particle is preferably 3 $\mu$m–15 $\mu$m and most preferably 5 $\mu$m–12 $\mu$m. As a process for adhering fine particles to the surfaces of core particles, there are mentioned a process for mixing these particles with each other mechanically and a process for mixing these particles in a liquid. Preferably, these particles are mixed in a liquid from the view point of the uniform adhesion of particles.

The carrier, which is mixed with the toner according to the present invention to form a developer, is not particularly limited, but preferably such a carrier having a mean particle size of 10–200 $\mu$m and containing ferrite as core. In this case, for the purpose to improve the durability in its continuous use, it may be preferable to use a coated carrier, in which the core is coated with a silicone resin, a fluorine resin and the like. Preferably, a carrier is used in an amount of 5–100 parts by weight referred to 1 part by weight of toner.

EXAMPLES

The present invention will be illustrated in detail hereinafter by the examples and synthetic examples but is limited by no means to these examples so long as within the scope of the present invention. The "part" in the examples means "part by weight".

Example 1

Production of Fine Particulate Polymer

A solution of 0.133 part of Compound No. 2 in 2.67 parts of ethyl methacrylate, and 150 parts of water were introduced into a 300 ml glass flask equipped with a cooling tube, a stirrer and a $N_2$ gas introducing tube. The mixture was heated at 70° C. with stirring. Under the $N_2$ atmosphere, 0.2025 part of potassium persulfate, 0.186 part of sodium thiosulfate and 0.012 part of cupric sulfate were added thereto.

After keeping the reaction at 70° C. for 5 hrs, a fine particulate polymer having a mean particle size of 0.095 $\mu$m was obtained.

Example 2

Production of Fine Particulate Polymer

A solution of 0.4 part of Compound No. 3 in 4 parts of styrene, 0.2 part of sodium dodecyl sulfate and 35 parts of water were introduced into the same glass flask as in Example 1. The mixture was heated at 80° C. with stirring and under $N_2$ atmosphere. 0.04 part of potassium persulfate was added thereto. After keeping the reaction at 80° C. for 5 hrs, 0.3 part of sodium dodecyl sulfate, 0.1 part of divinyl benzene, 4 parts of styrene and 35 parts of water were added, 0.04 part of potassium persulfate was added and the reaction was kept at 80° C. for 5 hrs, thereafter a fine particulate polymer having a mean particle size of 0.17 $\mu$m was obtained.

Example 3

Production of Fine Particulate Polymer

The reaction was carried out in the same manner as in Example 1 except that methyl methacrylate was used instead of ethyl methacrylate and 0.025 part of Compound No. 12 and 0.1 part of divinyl benzene were added, thereafter a fine particulate polymer having a mean particle size of 0.07 $\mu$m was obtained.

Example 4

Production of Fine Particulate Polymer

The reaction was carried out in the same manner as in Example 2 except that the Compound No. 20 was used in place of Compound No. 2, thereafter a fine particulate polymer having a mean particle size of 0.2 $\mu$m was obtained.

Example 5

Production of Fine Particulate Polymer

A solution of 0.133 part of Compound No. 5 in 2.67 parts of ethyl methacrylate and 0.0267 part of acrylic acid, and 36 parts of water were introduced into the same glass flask as in Example 1. The mixture was heated at 70° C. under $N_2$ atmosphere with stirring. 0.2025 part of potassium persulfate, 0.186 part of sodium thiosulfate and 0.012 part of cupric sulfate were added thereto. After keeping the reaction at 70° C. for 5 hrs, a fine particulate polymer having a mean particle size of 0.17 $\mu$m was obtained.

Example 6

Production of Fine Particulate Polymer

A solution of 0.025 part of Compound No. 7 in 2.5 parts of methyl methacrylate, and 150 parts of water were introduced into the same glass flask as in Example 1. The mixture was heated at 70° C. under $N_2$ atmosphere with stirring. 0.0405 part of potassium persulfate, 0.0372 part of sodium thiosulfate and 0.0012 part of cupric sulfate were added thereto. After keeping the reaction at 70° C. for 5 hrs, a fine particulate polymer having a mean particle size of 0.1 $\mu$m was obtained.

Example 7

Production of Core Particle (Suspension polymerization)

29.2 parts of styrene, 10.8 parts of 2-ethylhexyl acrylate, 2.3 parts of carbon black (Mitsubishi Kagaku, MA-100) and 6 parts of a resin of styrene-acrylic series (Mw=20,000) were treated for 10 hrs by a sand grinder mill to disperse carbon black. 1.6 parts of azobisisobutylonitrile was dissolved therein. The mixture was placed in 200 parts of water containing 5% tricalcium phosphate and treated at 8,000 rpm for 3 min by a homogenizer.

The treated solution was introduced into a 500 ml glass flask equipped with a cooling tube, a stirrer and a $N_2$ gas introducing tube. After heating at a 80° C. under $N_2$ atmosphere and keeping the reaction for 9 hrs, a suspension-polymerized toner (core particle) having a mean particle size of 8.3 μm was obtained.

Example 8

Production of Core Particle (Emulsion polymerization)

41 parts of styrene, 9 parts of n-butyl acrylate, 2 parts of acrylic acid and 50 parts of water as well as emulsifiers 0.5 part of EMULGEN 950 (polyoxyethylene nonyl ether of which HLB is 18.2) and 1 part of sodium dodecyl benzensulfonate were introduced into a 500 ml glass flask equipped with a cooling tube, a stirrer and a $N_2$ gas introducing tube. 0.25 part of potassium persulfate was placed thereto and the reaction was kept at 70° C. for 8 hrs under $N_2$ atmosphere. After cooling at a 25° C., 3.5 parts of carbon black (Mitsubishi Chemical, MA-100) and 150 parts of water were added and stirred for 4 hrs by a homogenizer, while increasing the temperature at a speed of about 0.15° C./min. The solution was placed in a similar glass flask and heated at 90° C. for 3 hrs, thereafter an emulsion polymerized toner (core particle) having a mean particle size of 9.0 μm was obtained.

Example 9

Production of Core Particle (Mixing)

100 parts of resin of styrene acrylic series and 5 parts of carbon black (Mitsubishi Chemical, MA-100) were mixed, pulverized and classified to yield a core particle having a mean particle size of 9.5 μm.

Example 10

Production of Toner According to the Present Invention

To 170g of the slurry of core particle produced in Example 7 was added 150 parts of the solution of fine particulate polymer produced in Example 1, hydrochloric acid was then added until the pH-value of the system becomes 1.0, and the system was stirred at 50° C. for 5 hrs. After standing for cooling, filtering, washing with water and then drying under vacuum, 41 parts of toner was obtained, on the surface of which fine particles were adhered. 0.12 part of hydrophobic silica was added to 40 parts of the toner and 960 parts of ferrite carrier mean particle size: 100 μm having the acrylcoat on its surface was mixed therein and stirred to make a developer. The quantity of charge of the toner was −29.5 μC/g on measuring by the blow-off method.

When the developer was used in a copier containing selenium as sensitive material, a clear copy was obtained.

Example 11

Production of Toner According to the Present Invention

The same procedure as in Example 10 was carried out to make a developer except that 40 parts of the polymer solution produced in Example 2 was added in place of the solution of fine particulate polymer produced in Example 1. When the developer was used for evaluation in the same copier as in Example 10, a clear copy was obtained.

Example 12

Production of Toner According to the Present Invention

The same procedure as in Example 10 was carried out to make a developer except that 150 parts of the polymer solution produced in Example 3 was added in place of the solution of fine particulate polymer produced in Example 1 and 250 parts of the slurry of the emulsion-polymerized toner produced in Example 8 was used without using hydrochloric acid. When the developer was used for evaluation in the same copier as in Example 10, a clear copy was obtained.

Example 13

Production of Toner according to the Present Invention

The same procedure as in Example 12 was carried out except that 40 parts of the polymer solution produced in Example 4 was added in place of the solution of fine particulate polymer produced in Example 1. 0.12 part of hydrophobic silica was added to 40 parts of the toner and 960 parts of ferrite carrier (mean particle size: 100) having the acrylcoat on its surface was mixed and stirred to make a developer. When the developer was used for evaluation in a copier containing OPC as sensitive material, a clear copy was obtained.

Example 14

Production of Toner According to the Present Invention

The same procedure as in Example 10 was carried out to make a developer except that 150 parts of the polymer solution produced in Example 5 was added in place of the solution of fine particulate polymer produced in Example 1 and 50 parts of toner produced in Example 9 was used without using hydrochloric acid. When the developer was used for evaluation in the same copier as in Example 10, a clear copy was obtained.

Example 15

Production of Toner According to the Present Invention

The same procedure as in Example 10 was carried out to make a developer except that 150 parts of the polymer solution produced in Example 6 was added in place of the solution of fine particulate polymer produced in Example 1 and 50 parts of core particle produced in Example 9 was used without using hydrochloric acid. When the developer was used for evaluation in the same copier as in Example 10, a clear copy was obtained.

Comparison Example 1

The same procedure as in Example 1 was carried out except that Compound No.2 was not added, thereafter a fine particulate polymer having a mean particle size of 0.1 μm was obtained.

The same procedure as in Example 10 was carried out to make a developer except that the fine particulate polymer produced as mentioned above was used, thereby the quantity of charge of the toner was −5.0 μC/g. When the developer was used for evaluation in a copier, only a copy containing many fogs was obtained.

What is claimed is:

1. A method of manufacturing an electrostatic image-developing toner, comprising polymerizing by emulsion polymerization a monomer in the presence of a charge controlling agent to form a polymer of fine particles having a mean particle size of 0.01–1 μm, wherein said charge controlling agent is present in an amount of from 0.5 to 10 parts by weight based on 100 parts of said polymer;

mixing said fine particles with core particles;

adhering said fine particles to the surfaces of said core particles;

wherein said charge-controlling agent is a compound represented by general formula (1):

$$A—(X—B)_n \quad (1),$$

wherein A represents an aromatic ring residue which may have a substituent;

B represents an aromatic ring residue which may have a substituent, an aliphatic residue which may have a substituent, or a hydrogen atom;

X represents —CONH—, —NHCO—, or —NHCONH—; and n represents an integer in the range from 1 to 3.

2. The method according to claim 1, wherein the mean particle size of said core particles is 3–15 $\mu$m.

3. The method according to claim 1, wherein said core particles are obtained by suspension polymerization.

4. The method according to claim 1, wherein said core particles are coagulated particles of the particles obtained by emulsion polymerization.

5. The method according to claim 1, wherein said fine particles are comprised of a polymer obtained from one or more monomers selected from the group consisting of styrene, α-methyl styrene, vinyl toluene, α-chlorostyrene, o-chlorostyrene, m-chlorostyrene, p-chlorostyrene, p-ethylstyrene, divinyl benzene, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, 2-hydroxyethyl acrylate, 3-hydroxypropyl acrylate, 4-hydroxybutyl acrylate, 2-hydroxyethyl methacrylate, ethyleneglycol dimethacrylate, tetraethyleneglycol dimethacrylate, acrylic acid, methacrylic acid, vinyl-n-butyl ether, vinylphenyl ether and vinylcyclohexyl ether.

6. The method according to claim 1, wherein said core particles are comprised of a polymer obtained from one or more monomers selected from the group consisting of styrene, α-methyl styrene, vinyl toluene, α-chlorostyrene, o-chlorostyrene, m-chlorostyrene, p-chlorostyrene, p-ethylstyrene, divinyl benzene, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, 2-hydroxyethyl acrylate, 3-hydroxypropyl acrylate, 4-hydroxybutyl acrylate, 2-hydroxyethyl methacrylate, ethyleneglycol dimethacrylate, tetraethyleneglycol dimethacrylate, acrylic acid, methacrylic acid, vinyl-n-butyl ether, vinylphenyl ether and vinylcyclohexyl ether.

7. The method according to claim 1, wherein A represents a benzene ring residue which may have a substituent or a naphthalene ring residue which may have a substituent;

B represents a benzene ring residue, a naphthalene ring residue, an alkyl radical of $C_1$–$C_{25}$, an alkenyl radical of $C_2$–$C_{22}$, an alkynyl radical of $C_2$–$C_{22}$, or an aliphatic ring residue of 3–7 members, each of the residues may have a substituent.

8. The method according to claim 1, wherein the mean particle size of said fine particles is 0.05–0.5 $\mu$m.

* * * * *